US006141917A

United States Patent [19]

Mueller

[11] Patent Number: 6,141,917

[45] Date of Patent: Nov. 7, 2000

[54] ROOF PANEL CONSTRUCTION AND METHOD OF MAKING SAME

[76] Inventor: George B. Mueller, 22307 Ridgeway Ave., Richton Park, Ill. 60471

[21] Appl. No.: 09/010,628

[22] Filed: Jan. 22, 1998

[51] Int. Cl.[7] ..... E04D 13/10

[52] U.S. Cl. ..... 52/24; 52/630

[58] Field of Search ..... 52/24, 25, 26, 52/536, 537, 519, 528, 630, 553, 554

[56] References Cited

U.S. PATENT DOCUMENTS

| | | | |
|---|---|---|---|
| Re. 14,449 | 3/1918 | Murphy | 52/630 |
| 1,096,218 | 5/1914 | Berry | 52/630 |
| 1,178,673 | 4/1916 | Plank | 52/630 |
| 1,410,945 | 3/1922 | Mayfield | 52/630 |
| 5,044,130 | 9/1991 | Chiddister | 52/24 |
| 5,205,088 | 4/1993 | Mueller | 52/24 |
| 5,653,071 | 8/1997 | Iwami et al. | 52/181 |
| 5,901,507 | 5/1999 | Smeja et al. | 52/24 |

*Primary Examiner*—Christopher T. Kent
*Assistant Examiner*—Jennifer I. Thissell
*Attorney, Agent, or Firm*—Foley & Lardner; Bernard L. Kleinke

[57] ABSTRACT

A roof panel construction includes a plurality of integral snow and ice gripping projections to help retain accumulated ice thereon and to guide the drainage of melted snow and ice therefrom during snow and ice melting ambient conditions. The projections are each convex in configuration to grip the frozen snow and ice and yet permit efficient drainage of the melted snow and ice thereover and therearound.

21 Claims, 2 Drawing Sheets

ROOF PANEL CONSTRUCTION AND METHOD OF MAKING SAME

BACKGROUND OF THE INVENTION

1. Technical Field

The present invention relates in general to a new and improved roof panel construction and a method of making it. The invention more particularly relates to such a roof panel construction, which prevents or greatly inhibits the avalanche of snow and ice therefrom to prevent dangerous conditions when slabs of snow and ice slide off of the roof. Such roof panel construction may be composed of metal, glass, plastic or other suitable materials.

2. Background Art

Snow and ice can accumulate on pitched roofs during winter months. When the snow and ice commences thawing due to weather conditions or the heat within the building itself, melting slabs of snow and ice can lubricate the roof panel and then slide under the force of gravity off of the roof in the form of a heavy block or sheet. Such a condition can damage the roof edges, adjacent property, and can be very dangerous, especially to a passerby near the roof.

In an attempt to overcome this potentially dangerous problem, snow guards have been employed on roofs where such conditions could arise. The snow guards are typically small upright plates which have a base secured to the roof by suitable attachment means, such as an adhesive. The snow guard holds back a block of snow and ice to prevent it from being dislodged from the roof. However, the weight of the snow and ice accumulation can be considerable, and depending upon the pitch of the roof, the adhesive or other fastening device can fracture or otherwise fail, and the snow guard then breaks off and is discharged with the block of accumulated snow and ice behind it. Thus, such devices are not entirely satisfactory for many applications. Also, they are costly to install.

In order to overcome this problem, a roof panel having integral snow and ice gripping projections formed therein has proven to be highly effective, and is disclosed in U.S. Pat. No. 5,205,088. Such a roof panel construction employs integral upward or top side projections which are structurally strong to help retain the heavy accumulations of snow and ice to prevent or inhibit them from sliding off of the roof.

While such a construction has proven to be highly successful, it may sometimes be advantageous to enable such a construction to facilitate the complete drainage of melted snow and ice from the roof to avoid standing pools of melted snow and ice. Such standing pools can produce staining of the roof and is thus not desirable. Therefore, it would be highly desirable to have such a new and improved integral snow and ice retention devices, which also facilitate the drainage of melted snow and ice therefrom.

SUMMARY OF THE INVENTION

The principal object of the present invention is to provide a new and improved snow and ice retention roof panel construction and a method of making it, wherein the construction also facilitates greatly the drainage of melting snow and ice therefrom.

Briefly, the above and further objects of the present invention are realized by providing a new and improved snow and ice retention roof panel construction and a method of making it, whereby snow and ice blocks are retained in place to inhibit them from being dislodged from the roof. When the blocks melt, the melted snow and ice drains efficiently therefrom with little or no moisture retention thereon.

A roof panel construction includes a plurality of integral snow and ice gripping projections to help retain accumulated snow and ice thereon and to guide the drainage of melted snow and ice therefrom during snow and ice melting ambient conditions. The projections are each convex in configuration to grip the frozen snow and ice and yet permit efficient drainage of the melted snow and ice thereover and therearound.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 6:
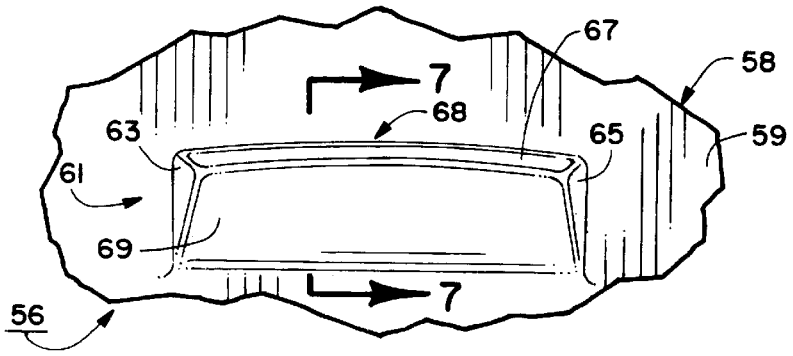
FIG. 6 is a plan view of a portion of a snow and ice gripping roof panel construction, which is constructed in accordance with the present invention.

Referring now to the drawings, and more particularly to FIGS. 1, 2, 3, 4 and 5 thereof, there is shown a roof panel construction 10, which is made in accordance with the present invention. The roof panel construction 10 facilitates the gripping of snow and ice accumulation to help prevent it from becoming dislodged therefrom. The construction 10 also permits melting snow and ice to break up and to drain off remaining moisture. The roof panel construction of the present invention may be composed of suitable material, such as metal, glass plastic or other appropriate substrates.

The roof panel construction 10 generally comprises a set of generally rectangularly flat roof panels, such as the panels 12, 13 and 14. It will be apparent to those skilled in the art that the desired length of the panels are adjusted to a given size roof, and there are a suitable number of the panels arranged in a side-by-side arrangement to cover the entire roof (not shown).

A seam 16 interconnects the side marginal edges of the adjacent panels 12 and 13. Similarly, a seam 18 interconnects the side marginal edges of the adjacent panels 13 and 14. The hydrostatic roof panel construction 10 includes central reinforcing ribs 21, 23 and 25 of the respective panels 12, 13 and 14. It will become apparent to those skilled in the art that the present invention is equally adaptable to hydrokinetic roof panel constructions (not shown) which do not employ the longitudinal ribs for the panels.

The panels 12, 13 and 14 are generally similar to one another. Thus, only the panel 12 will be described in greater detail. The panel 12 includes a plurality of outwardly extending projections generally indicated at 26 integrally formed in a base sheet 30 of the panel 12. The plurality of integrally formed low profile snow and ice gripping smoothly contoured projections facilitate gripping snow and ice accumulations to help prevent them from becoming dislodged from the roof panel construction 10. The projections also facilitate the permitting of melting snow and ice to break up and to drain off remaining moisture. The low profile of the projections does not promote the accumulation of snow and ice. However, if such an accumulation does occur, then an inevitable icy layer at the bottom of the accumulation is gripped securely and held in place to prevent undesirable and unwanted avalanches of snow and ice from the roof panel construction 10.

The icy layer is inevitably formed due to the radiant sun melting of snow resulting in flowing water at the bottom of the accumulation. In this regard, radiant heat from the sun directed on a bare portion of the roof panel construction 10 causes heating of the roof panel construction 10. As a result, melted snow flows in the form of water downwardly along the roof panel construction 10. The water then flows into and under accumulated snow, and then freezes due to the shading of the roof panel construction 10 from the sun. The top layers of the snow accumulation also melts and the melted snow then seeps downwardly to further accumulate in the form of an icy layer at the bottom of the snow accumulation. The resulting icy layer then becomes firmly attached to the plurality of outwardly extending projections generally indicated at 26.

Snow can blow over the low profile projections without causing a deep accumulation of snow. However, if such accumulation occurs, it is gripped by becoming attached to the inevitable bottom icy layer.

Once ambient temperature heat from the sun or heating from the interior of the building (not shown) causing melting of the snow and ice, the melted snow and ice can slide off of the roof panel construction 10 and in so doing, becomes broken apart by the plurality of projections 26. Thus, the broken apart snow and ice particles can fall safely from the roof panel construction 10.

The plurality of projections is arranged in a pair of longitudinally spaced-apart clusters 27 and 29 for providing an aesthetically pleasing appearance and for gripping spaced-apart portions of slabs of the snow and ice accumulations (not shown). A blank intermediate area 32 of the base sheet 30 is disposed between the clusters 27 and 29.

The down roof cluster 29 is disposed further down roof than a corresponding cluster 33 (FIG. 1) of the adjacent panel 13, and in line with a corresponding cluster of the panel 14. In this regard, the panels are arranged in two types of panels which alternate with one another. The panels 12 and 14 are like panels and thus have their projections arranged in common rows. The panel 13 is similar but has its projection clusters staggered relative to the corresponding projection clusters of the panels 12 and 14. Thus, the clusters of projections of the rool construction 10 are arranged in staggered rows to facilitate snow and ice gripping and to facilitate drainage of melting snow and ice.

Each one of the clusters of projections are similar to one another, and thus only the cluster 27 will now be described in further detail. The cluster 27 includes a group of five projections, such as the projection 35 disposed on one side of the rib 21 and a similar group 36 of five projections on the other side of the rib 21. The projections of the group 34 are arranged in staggered rows 38, 41 and 43 (FIG. 3), and staggered columns 37, 39 and 40. By staggering the rows and columns, the snow and ice gripping is facilitated, and the drainage of moisture from melting snow and ice is also facilitated. In this regard, when snow and ice melts on the roof panel construction 10, the liquid flows over the smoothly contoured projections, such as the projection 35 and also is permitted to flow downwardly between the down roof pair of projections 48 and 50 of the group 34.

Considering now the projections, such as the projection 35 in greater detail, the projection 35 is generally cup shaped and has a snow and ice upstanding arresting face portion 45, which faces up roof. The projection 35 is elongated and has a pair of end portions 44 and 46. A sloping back portion 47 extends between the arresting face portion 45 and the base sheet 30.

Figure 4:
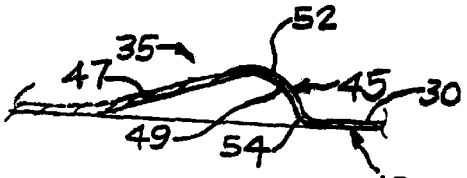
FIG. 4 is an enlarged sectional view of FIG. 3 taken substantially on line 4—4 thereof.
Figure 5:
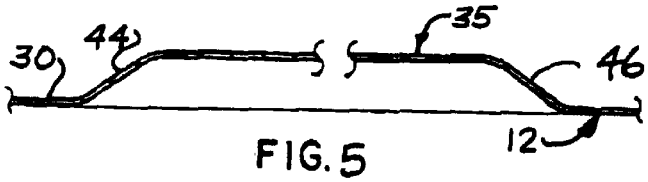
FIG. 5 is an enlarged sectional view of the roof panel construction portion of FIG. 3 taken substantially on line 5—5 thereof.
Figure 3:
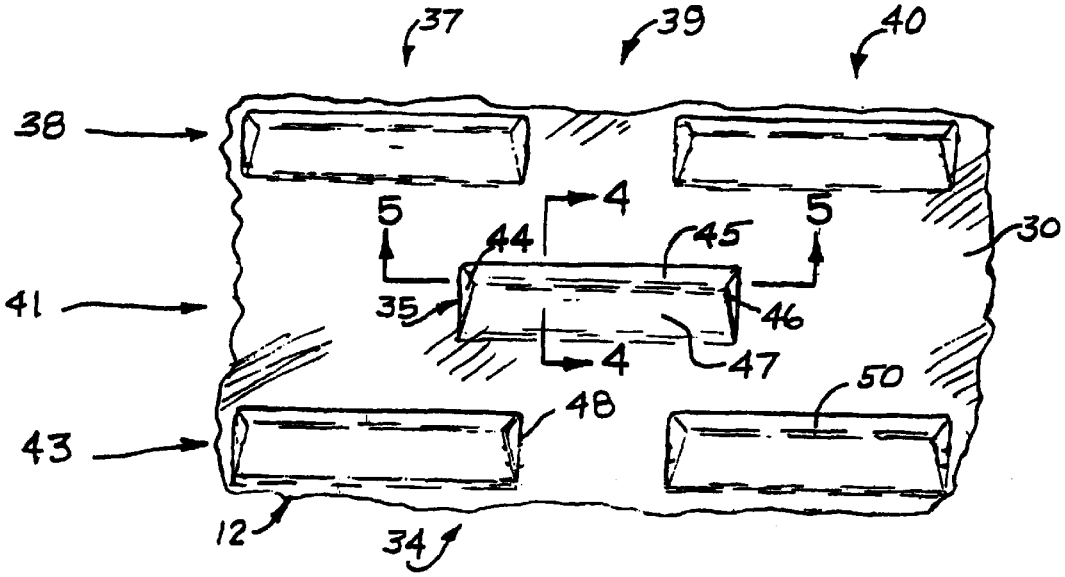
FIG. 3 is a plan view of the roof panel construction portion of FIG. 2.

As shown in FIG. 4, the arresting face portion 45 is generally convex and includes an upright generally convex intermediate portion 49 which extends between a smoothly rounded top portion 52 and a smoothly rounded bottom portion 54, which is integrally connected to the base sheet 30. The top portion 52 is integrally connected to the back portion 47.

The arresting face portion is convex in shape and has a slightly outwardly bulbous configuration. The convex portion includes the generally convex intermediate portion 49 and the smoothly rounded top and bottom portions 52 and 54.

The convex arresting face portion is generally upright and is inclined at an angle to the plane of the base sheet 30. The angle is an obtuse angle between about 90° and about 150°. The angle is more preferably an angle between about 105° and about 135°. The angle is preferably 120°.

Figure 7:
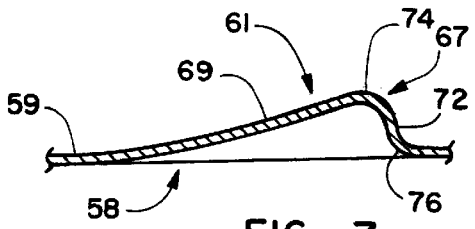
FIG. 7 is an enlarged sectional view of the roof panel construction portion of FIG. 6 taken substantially on line 7—7 thereof.

Referring now to FIGS. 6 and 7 of the drawings, there is shown a roof panel construction generally indicated at 56, which is made in accordance with the present invention. The roof panel construction 56 is generally similar to the roof panel construction 10, except that the roof panel construction 56 includes a modified projection.

The construction 56 includes a roof panel 58 having a base sheet 59, which includes a plurality of elongated projections, such as a projection 61.

Figure 1:
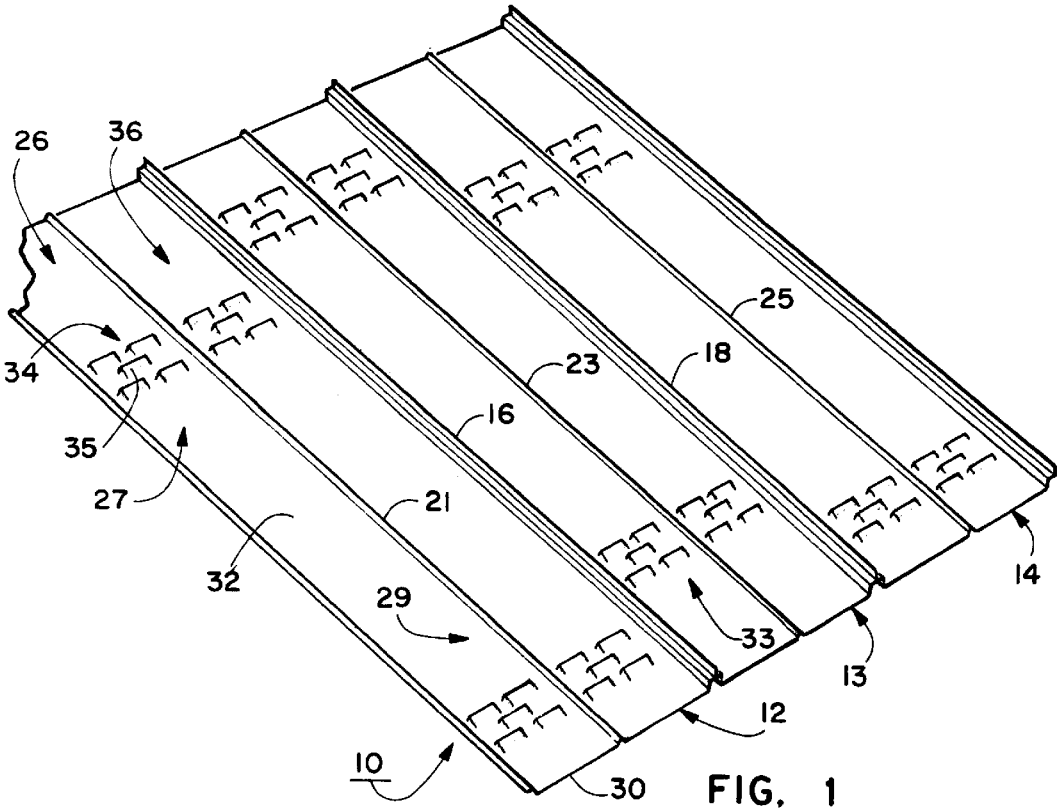
FIG. 1 is a partially broken away pictorial view of a snow and ice gripping roof panel construction, which is constructed in accordance with the present invention.
Figure 2:
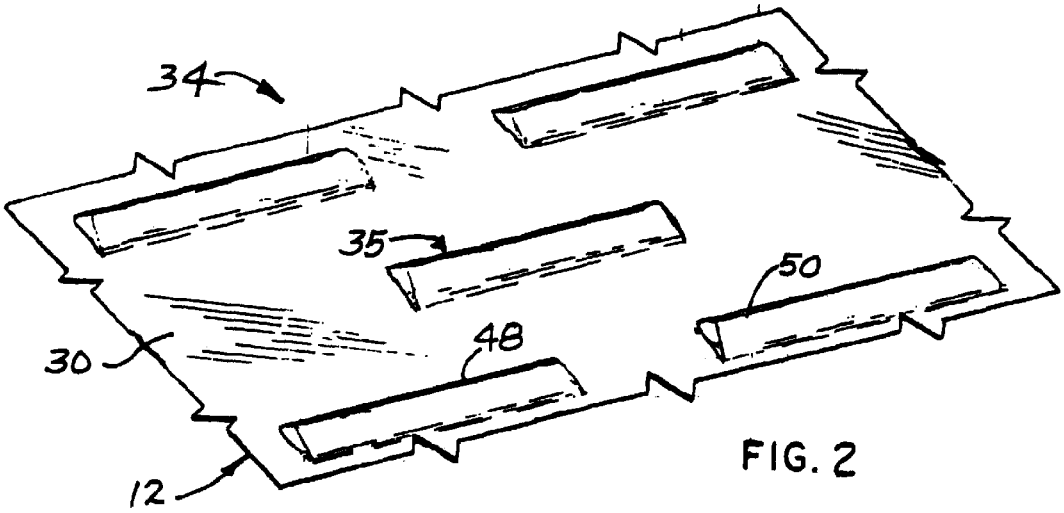
FIG. 2 is an enlarged pictorial view of a portion of the roof panel construction of FIG. 1.

The projection 61 is elongated in shape and is generally similar to the projection 35 of FIG. 1. The projection 61 includes a pair of end portions 63 and 65. A snow and ice upstanding arresting face portion 67 includes a smoothly rounded or curved aspect or configuration between the end portions 63 and 65 to provide the projection 61 with a generally planar shape. In this regard, the projection 67 includes an angularly sloping back portion 69 integrally connected to the arresting face 67 and to the base sheet 59 to help facilitate movement of melted snow and ice thereover, and yet the projection 67 grips frozen snow and ice accumulation thereon. The back portion 69 joins the base sheet 59 in a smoothly contoured manner and is curved in configuration in plan view as indicated in FIG. 6.

The arresting face 67 includes an upstanding generally planar portion 72 which extends between a smoothly rounded top portion 74 and a smoothly rounded bottom portion 76. The angle of the arresting face 67 relative to the base sheet 59 falls within the range of angles for the arresting face portion of the projections of FIG. 1.

Figure 8:
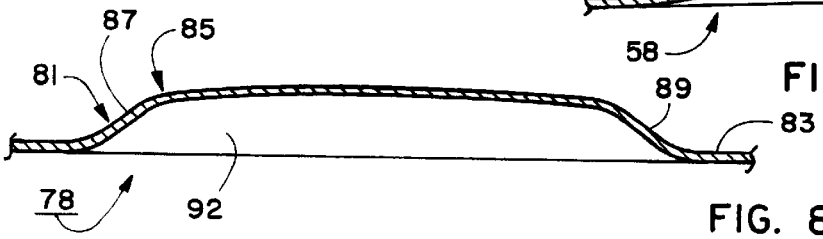
FIG. 8 is a portion of another snow and ice gripping roof panel construction, which is constructed in accordance with the present invention.

Referring now to FIG. 8, there is shown a roof panel construction 78, which is made in accordance with the present invention. The roof panel construction 78 is similar to the construction 1, except that the projections are somewhat modified. The roof panel construction 78 includes a roof panel 81 having a base sheet 83 with an elongated projection 85 disposed therein. The projection 85 is elongated and is similar to the projection 35 of FIG. 1. The projection 85 includes a pair of end portions 87 and 89. A snow and ice upstanding arresting face portion 92 is similar to the arresting face portion of the projection 35, except that the face portion 92 is tapered end to end. In this regard, the arresting face portion 92 is convex in its configuration. As shown in FIG. 8, the height is the greatest at its central mid portion and gradually decreases in height from the central portion to the end portions. The convex configuration facilitates the drainage of melted snow and ice from the roof panel construction 78 in accordance with the present invention, and yet the projection 85 facilitates the gripping of accumulated snow and ice thereon.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A roof panel construction, comprising:

a first plurality of alternating like elongated roof panels each having a group of intgral low profile snow and ice gripping smoothly contoured projections for gripping the ice base portion of the snow and ice accumulation to help prevent it from becoming dislodged therefrom and for permitting melting snow and ice to break up and to drain off remaining moisture, said group of projections being arranged in a pair of tight clusters longitudinally disposed at substantially regular intervals for providing an aesthetically pleasing appearance and for gripping spaced apart portions of slabs of the snow and ice accumulations, the projections within each cluster being arranged in staggered columns of said projections, each projection being cup shaped and having an upstanding convex, outwardly bulbous arresting face portion integrally connected to an angularly sloping back portion, said arresting face portion including an upright intermediate portion interconnecting a smoothly rounded top portion and a smoothly rounded bottom portion, and each cluster having a longitudinal dimension substantially smaller than the spacing between longitudinally adjacent clusters;

a second plurality of alternating like adjacent elongated roof panels similar to the first plurality each having a group of integral low profile snow and ice gripping smoothly contoured projections for gripping an ice base portion of the snow and ice accumulation to help prevent it from becoming dislodged therefrom and for permitting melting snow and ice to break up and to drain off remaining moisture, said group of projections being arranged in a pair of longitudinally spaced apart clusters for providing an aesthetically pleasing appearance and for gripping spaced apart portions of slabs of the snow and ice accumulations, the projections of each of the last-mentioned cluster being arranged in staggered columns of said projections, and the first-mentioned roof panels and the adjacent roof panels being disposed in an alternating pattern to position said clusters in staggered rows; and the clusters of projections of the first roof panels being staggered longitudinally to those of the second roof panels to facilitate gripping of snow and ice accumulations and to facilitate the breaking up of accummulations as they become dislodged.

2. The construction according to claim 1, wherein the convex arresting face portion has a slightly outwardly bulbous configuration.

3. The construction according to claim 1, wherein the convex portion includes an upright generally, planar portion interconnecting a smoothly rounded top portion and a smoothly rounded bottom portion.

4. The construction according to claim 1, wherein each one of said panels includes a base sheet, and wherein the convex arresting face portion is generally upright and is inclined at an angle to the plane of its base sheet, said angle being an obtuse angle.

5. The construction according to claim 4, wherein said angle is between about 90° and about 150°.

6. The construction according to claim 5, wherein said angle is between about 105° and about 135°.

7. The construction according to claim 6, wherein said angle is about 120°.

8. The construction according to claim 1, wherein each one of said projections is elongated and has a pair of end portions.

9. The construction according to claim 8, wherein said convex portion and has a smoothly curved configuration between said end portions in its plan view.

10. The construction according to claim 1, wherein each one of said projections is elongated and has a pair of end portions, and a convex portion being tapered in its height dimension between said end portions, said height dimension being the greatest at its central mid portion and diminishing gradually in height from the central mid portion to the end portions.

11. The construction according to claim 1, wherein the longitundinally staggered spacing facilitates moisture drainage.

12. An elongated roof panel comprising:

a base sheet; and a plurality of outwardly extending projections integrally formed in staggered columns in said base sheet into tight clusters longitudinally disposed at substantially regular periodic intervals along the panel for providing an aesthetically pleasing pattern for both gripping snow and ice accumulations and breaking up and draining them when they become dislodged, each cluster having a longitudinal dimension substantially smaller than the longitudinal spacing between adjacent clusters;

each projection being cup shaped and having a snow and ice upstanding convex, outwardly bulbous arresting face portion integrally connected to an angularly sloping back portion, said arresting face portion including an upright intermediate portion interconnecting a smoothly rounded top portion and a smoothly rounded bottom portion for facilitating gripping the snow and ice accumulations and efficiently draining melted snow and ice.

13. An elongated roof panel according to claim 12, wherein said angle is between about 90° and about 150°.

14. An elongated roof panel according to claim 13, wherein said angle is between about 105° and about 135°.

15. An elongated roof panel according to claim 14, wherein said angle is about 120°.

16. An elongated roof panel according to claim 12, wherein each one of said projections is elongated and has a pair of end portions.

17. An elongated roof panel according to claim 16, wherein said convex portion has a smoothly curved configuration between said end portions in its plan view.

18. An elongated roof panel according to claim 12, wherein each one of said projections is elongated and has a pair of end portions and a convex portion tapered in its height dimension between said end portions, said height dimension being the greatest at its central mid portion and diminishing gradually in height from the central mid portion to the end portions.

19. A method of making a roof, comprising:

forming integral, outwardly smoothly extending projections in elongated roof panels, each projection having its arresting face portion facing one of the ends of its panel, said arresting faces each having a convex shaped portion;

arranging the projections in each panel in tight clusters in a longitudinally generally periodically spaced apart manner;

arranging the projections within each cluster in staggered columns of said projections; and mounting the roof panels in place in a side by side manner to form the roof with clusters of laterally adjacent panels in staggered rows to facilitate snow and ice gripping and to facilitate drainage of melting snow and ice therefrom.

20. A method according to claim 19, further including arranging each cluster in staggered rows and columns to help grip snow and ice thereon and to facilitate drainage of melted snow and ice therefrom.

21. The method of claim 19 wherein the step of arranging projections in each panel further includes shaping each projection as cup shaped and having a snow and ice upstanding convex, outwardly bulbous arresting face portion integrally connected to an angularly sloping back portion, said arresting face portion including an upright intermediate portion interconnecting a smoothly rounded top portion and a smoothly rounded bottom portion for facilitating gripping the snow and ice accumulations and efficiently draining melted snow and ice.

* * * * *